US006644153B1

(12) United States Patent
Gordon

(10) Patent No.: US 6,644,153 B1
(45) Date of Patent: Nov. 11, 2003

(54) EJECTOR CONFIGURATION AND METHOD AND APPARATUS FOR MOUNTING THE SAME

(75) Inventor: Kevin T. Gordon, Chisago City, MN (US)

(73) Assignee: Jonco Die Company, Inc., Mounds View, MN (US)

( * ) Notice: Subject to any disclaimer, the term of this patent is extended or adjusted under 35 U.S.C. 154(b) by 0 days.

(21) Appl. No.: 09/644,412

(22) Filed: Aug. 23, 2000

Related U.S. Application Data

(60) Provisional application No. 60/179,783, filed on Feb. 2, 2000, and provisional application No. 60/181,253, filed on Feb. 9, 2000.

(51) Int. Cl.[7] ..... B26D 7/18

(52) U.S. Cl. ..... 83/27; 83/116; 83/128; 83/139; 493/342; 493/472

(58) Field of Search ..... 83/27, 139, 123, 83/128, 117, 116, 115, 118, 113, 653, 103, 138; 493/60, 64, 82, 83, 342, 373, 472

(56) References Cited

U.S. PATENT DOCUMENTS

| | | | | | |
|---|---|---|---|---|---|
| 2,302,855 | A | * | 11/1942 | Hallman | 83/117 |
| 2,424,678 | A | * | 7/1947 | Collinson | 83/123 |
| 2,679,291 | A | * | 5/1954 | Collinson | 83/130 |
| 3,198,093 | A | * | 8/1965 | Kirby et al. | 493/472 |
| 3,288,007 | A | * | 11/1966 | Eda et al. | 83/117 |
| 3,559,517 | A | * | 2/1971 | Smith et al. | 83/117 |
| 3,921,481 | A | * | 11/1975 | Fleetwood | 83/117 |
| 3,946,627 | A | | 3/1976 | Hofmann | |
| 3,981,213 | A | * | 9/1976 | Lopman | 493/60 |
| 4,224,851 | A | | 9/1980 | Imai | |
| 4,306,476 | A | * | 12/1981 | Saunders et al. | 83/117 |
| 4,444,075 | A | * | 4/1984 | Mulry | 83/128 |
| 4,499,802 | A | * | 2/1985 | Simpson | 83/117 |
| 4,896,573 | A | * | 1/1990 | Kapolnek | 83/117 |
| 5,111,725 | A | | 5/1992 | Simpson et al. | |
| 5,417,132 | A | * | 5/1995 | Cox et al. | 83/116 |
| 5,546,839 | A | * | 8/1996 | Gardiner | 83/128 |
| 5,636,559 | A | * | 6/1997 | Smithwick et al. | 83/116 |
| 6,071,225 | A | * | 6/2000 | Kucharski | 493/472 |

FOREIGN PATENT DOCUMENTS

| | | |
|---|---|---|
| GB | 2335880 | 10/1999 |
| GB | 2335881 | 10/1999 |

* cited by examiner

*Primary Examiner*—Stephen Choi
(74) *Attorney, Agent, or Firm*—Dorsey & Whitney LLP

(57) ABSTRACT

A method and apparatus for mounting an ejector to a die board including an ejector retaining recess in the die board and a portion of the ejector retained in such base without glue.

17 Claims, 6 Drawing Sheets

EJECTOR CONFIGURATION AND METHOD AND APPARATUS FOR MOUNTING THE SAME

This application claims the benefit of Provisional Application No. 60/179,783 filed Feb. 2, 2000 and Provisional Application No. 60/181,253 filed Feb. 9, 2000.

BACKGROUND OF THE INVENTION

1. Field of the Art

The invention relates generally to a method and apparatus for mounting an ejector to a die board and more particularly, to a glueless method and apparatus for mounting an ejector to a die board. The present invention also relates to an ejector configuration and more specifically to an ejector configuration for a rotary die.

2. Description of the Prior Art

The processing of sheet material such as corrugated board and the like to form a box, display device or the like, normally involves utilizing a rotary or flat cutting die. Various cutting and creasing rules are mounted to the cutting die to cut a blank of sheet material and provide it with various cuts, slits, scores and perforated lines for the purpose of forming tear-out areas, punched out areas, profiles, fold lines, etc. in the blank.

A rotary cutting press is constructed of two parallel mounted cylinders, namely, a die roll and an anvil roll which rotate counter to each other. One cylinder known as the cutting cylinder or die roll includes a die board and serves the purpose of driving a cutting die toward the other cylinder which is commonly known as the anvil cylinder. The anvil cylinder may be constructed of steel, or steel that is covered with a resilient material such as urethane. The cutting cylinder drives the cutting or creasing rule against the anvil surface to thereby cut, score, slit, etc. the sheet material introduced into the nip area between the rolls. A plurality of scrap ejectors are connected with the die board and associated with the cutting rules for ejecting the paperboard or corrugated stock away from the cutting and scoring rules as the sheet material passes through the nip between the rules. These scrap ejectors can take a variety of forms such as those shown in U.S. Pat. No. 5,111,725 issued to Simpson, U.S. Pat. No. 4,224,851 issued to Imai, and U.S. Pat. No. 3,946,627 issued to Hofmann. A common form of scrap ejector, however, is to use a piece of rubber or rubber-type material of various heights, shapes and densities adjacent or near the cutting rule to perform this scrap ejecting function. In general, the rubber material is secured to the surface of the die board in the scrap areas and are generally higher than the product ejection pieces. As the sheet material is fed through the nip between the rolls, the rubber material is compressed and the sheet material is cut or scored. Then, as the sheet material leaves the nip area, the rubber material expands, thereby ejecting the scrap away from the cutting rule or urging the sheet material away from the creasing rule.

The current method of mounting these rubber ejectors to a cutting die is to glue the various rubber blocks to the die board using several different methods. One of the most common methods is to use a contact adhesive that is brushed onto the outer surface of the die board in the areas where the rubber is to be mounted and onto the rubber pieces that will be mounted to the die board. A disadvantage of using contact adhesives is that the glue must be allowed to dry until it becomes tacky enough to form an instant bond between the die board and the rubber. Failure to do so will result in an incomplete bond around the outer edges of the rubber pieces, thereby allowing dust to build up in the gaps and eventually push the rubber piece loose from the die board. Although thinning agents can be added to the contact adhesive to reduce the drying time, this often adversely affects the bond. Further, replacement of rubber that has been glued to the die board with contact adhesive is quite labor intensive and often requires removing the rubber by chiseling it loose from the die board.

Another method is to mount the rubber to a rotary die using super glue because it sets fast and forms a strong bond. However, because most die boards are constructed of wood which is porous, the wood can soak up the glue before the rubber piece has had time to bond to the die board. Further, the uneven surface and voids that are sometimes present on wood can result in an incomplete bond. Although various means can be used to limit the rate at which the super glue is absorbed into the wood such as first sealing the wood or using a primer to reduce the set time of the glue, these all require extra time. Further, super glue is less flexible than other glues and does not allow the rubber to flex in the area of the bond between the die board and the rubber.

Pressure sensitive adhesives have also been used to secure the rubber to the die board. One type is a thin film, double sided adhesive which is applied to the rubber in sheet form. Another is applied to the rubber in liquid form. Both are intended to be used by applying the rubber with the pressure sensitive adhesive thereon directly to the board without the use of additional glues. However, pressure sensitive adhesives are sensitive to heat and directional forces. Accordingly, heat generated during a press run will often soften the adhesive to the point where directional forces of the die may cause the rubber to slide out of its desired location.

All three of the above glueing methods require special training, materials and tools both when the ejectors are applied to the die board initially as well as when repairs must be made. Because these repairs are frequently done when an ejector has failed during a production run and without removing the die board from the rotary press, the repairs must be made as quickly as possible to limit the amount of machine downtime. At the same time, if the repairs are done too quickly, so that they are done incorrectly, the die will not perform well and will limit the potential efficiency of the press.

Further, although the rubber scrap ejecting elements can be of various types, heights, shapes and densities, they are commonly rectangular blocks or strips that are glued to a surface of the die board or a recess therein. Most rubber scrap ejectors extend outwardly from the surface of the die board in a direction generally perpendicular or normal to the outer surface of the die board. Thus, as the rubber ejector passes through the nip between the rollers, the rubber is compressed and then springs back to eject the scrap material. Various other "cantilever" type scrap ejectors also exist. Examples include those illustrated in U.S. Pat. Nos. 5,111,725, 4,224,851 and 3,946,627. A scrap ejector constructed exclusively of a rubber-type material also exists in the form of a generally V-shaped ejector with one leg of the V glued to the die board and the other leg of the V extending in cantilever fashion outwardly at an angle from the die board. In this ejector, the cantilever portion of the scrap ejector is compressible about the junction point of the V and functions to exert an outward force against the scrap material after passing through the nip between the rollers. Despite these prior designs, however, a need continues to exist for improved and longer lasting scrap ejectors.

Accordingly, there is a need it the art for an improved ejector configuration and design such as a scrap or product ejector or the like which is constructed solely of rubber or a rubber-like material and also an improved method and apparatus for mounting rubber or rubber-type ejectors to a die board without the use of glue.

SUMMARY OF THE INVENTION

In contrast to the prior art, the present invention provides a unique ejector and a unique mounting concept by which the ejector, and in particular an ejector constructed exclusively of a rubber material, can be mounted to a die board of a cutting die without the use of glue. Although, the main use of the ejector of the present invention is as a scrap ejector, the concepts and structure of the invention may also be used for product ejection, for sheet control or for other purposes. Thus, unless otherwise qualified, the term ejector or scrap ejector shall mean an ejector for product ejection, sheet control and other purposes.

More specifically, the mounting apparatus is comprised of a die board having an outer surface and an inner surface and an ejector retaining recess within the die board. The ejector retaining recess includes an opening in the outer surface of the die board and a recess shoulder portion positioned between the outer and inner surfaces of the die board.

The ejector to be mounted in this retaining recess is preferably constructed exclusively of rubber or a rubber-like material which is flexible and compressible. This ejector element generally includes a mounting end for mounting to the retaining recess in the die board, an opposite free end and an intermediate or ejector portion positioned between the mounting end and the free end. The mounting end preferably includes a neck portion and a pair of protruding shoulder portions extending outwardly from the walls of the neck. Preferably, the size and cross-sectional configuration of the ejector neck approximates the size and cross-sectional configuration of neck portion in the die board recess and the size and configuration of the protruding shoulder portions approximates the size and configuration of the retaining shoulder portions of the die board. Accordingly, when the mounting end of the ejector element is inserted into the retaining recess, engagement between the corresponding neck portions and the protruding and retaining shoulder portions secures the ejector element to the die board.

The ejector element in accordance with the present invention can be constructed of a variety of materials; however, it is contemplated that the ejector element will be constructed of a single rubber or rubber-like material throughout its entirety. The specific rubber-type material may vary depending upon specific uses and its expected life span. For example, a more costly and durable elastomer may be selected for use on high volume dies, while a lower cost and less durable rubber or elastomer may be used on low volume dies. The preferred embodiment is a closed cell and highly durable synthetic polyurethane elastomer material sometimes referred to as "vulcell elastomer". In general, any material, whether natural or synthetic, which is compressible or resilient and compressible can function as the ejector material in accordance with the present invention Accordingly, it is an object of the present invention to provide an improved mounting system for an ejector such as a scrap ejector.

Another object of the present Invention is to provide a cutting die with an improved ejector mounting system.

A further object of the present invention is to provide a glueless ejector mounting system for a die board.

Another object of the present invention is to provide an improved ejector structure.

A still further object of the present invention is to provide a method of mounting a rubber or rubber-like ejector to a die board.

These and other objects of the present invention will become apparent with reference to the drawings, the description of the preferred embodiment and the appended claims.

DESCRIPTION OF THE PREFERRED EMBODIMENT

The present invention relates to an improved method and apparatus for mounting an ejector member, and more specifically a scrap ejector member, relative to a die board in a cutting die. The invention also relates to improved structures for ejector members. Although the present invention has particular applicability to sheet material commonly referred to as corrugated cardboard or paperboard, it also has potential applicability for paperboard which is not corrugated and various other forms of sheet material. Thus, unless otherwise specified, the term "sheet material" as used herein shall mean any sheet material with which the present invention is usable including, but not limited to, corrugated paperboard, non-corrugated paperboard and the like.

Further, the apparatus with which the ejector members and ejector mounting concepts have particular application are cutting dies which utilize a die board to which the ejector members are mounted. Such die boards are connected to and used with what are commonly referred to as rotary dies, flat dies or any other form of dies. The description of the preferred embodiment, however, will be with reference to a rotary die.

Still further, as mentioned above, although the description of the preferred embodiment will be with reference to a scrap ejector, such term, as well as the term ejector, shall be construed as covering other uses of the ejector as well.

Figure 1:
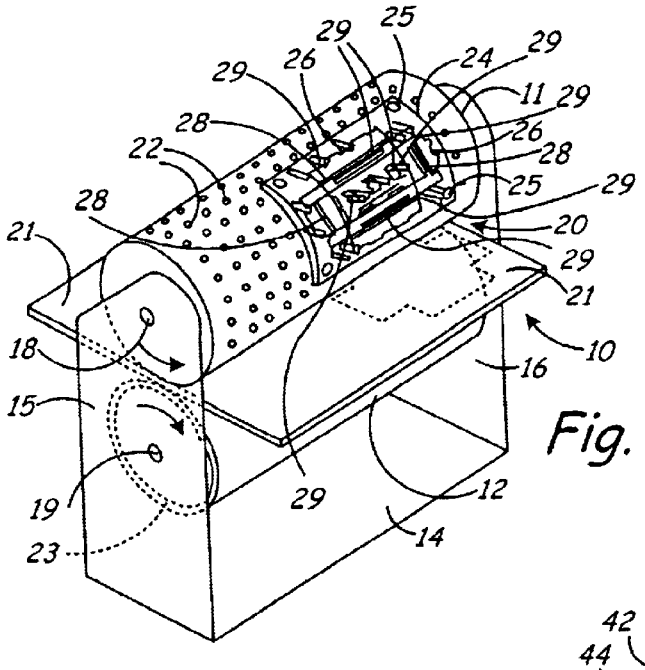
FIG. 1 is an isometric view of a rotary press embodying a die board.

In describing the present invention, reference is first made to FIG. 1 which shows a conventional rotary press 10 embodying a die board with a cutting rule and a plurality of ejector members in accordance with the present invention. The rotary press 10 of FIG. 1 includes a die roll or cylinder 11, an anvil roll or cylinder 12 and a support structure comprising a base 14 and a pair of side supports 15 and 16. The die and anvil cylinders 11 and 12 are rotatably mounted in the side supports 15 and 16 about their respective rotation axes 18 and 19. During operation, the cylinders 11 and 12 rotate about their axes 18 and 19 in opposite directions as shown by the directional arrows.

The cylinders 11 and 12 are adjacent to one another as shown, but are slightly spaced to define a nip 20 through which a panel of sheet material 21 passes during operation. The die cylinder 11 is a right cylindrical metal roller having a plurality of internally threaded mounting holes 22 extending axially across and circumferentially around the roll 11. The anvil cylinder 12 is also a generally right cylindrical member having a core portion constructed of metal. It is common for the anvil cylinder 12 to be provided with an external cutting blanket 23 constructed of urethane or a similarly compressible material. In some applications, however, an anvil cylinder with a steel exterior is utilized.

A die board including a plurality of cutting and creasing rules is securely mounted to the die cylinder 11 by a plurality of externally threaded members 25 such as bolts threadedly received in the mounting holes 22. The die board 24 is conventionally constructed of a material such as plywood and has a curvature substantially matching the curvature of the exterior surface of the cylinder 11. The die board 24 normally has a thickness ranging from about ⅜ to about ⅝ of an inch, but other thicknesses can be used as well. A plurality of cutting, creasing, slitting or other rules are conventionally mounted to the die board 24 to perform desired operations on the sheet material 21. In the embodiment of FIG. 1, the die board is provided with a plurality of cutting rules 26 for cutting the sheet material into a product blank and a plurality of creasing rules 28 for forming folding scores on the product blank cut from the sheet material 21 in accordance with the present invention. Also mounted to the die board 24 are a plurality of ejection elements 29 in accordance with the present invention. As will be described in greater detail below, these elements 29 force the product and/or scrap material away from each other and outwardly and away from the die cylinder 11 and the die board 24 during the cutting and creasing process.

The general structure of the rotary die of the rotary press illustrated in FIG. 1 is conventional and known in the art. During operation, the die and anvil cylinders 11 and 12 rotate in the direction of the indicated arrows and the panel of sheet material 21 is fed into the nip 20 between the rollers. As the rules 26 and 28 of the die board engage the sheet material 21, the sheet material is cut into a product blank having a desired configuration and folding scores are formed on the product blank at desired locations.

Figure 2:
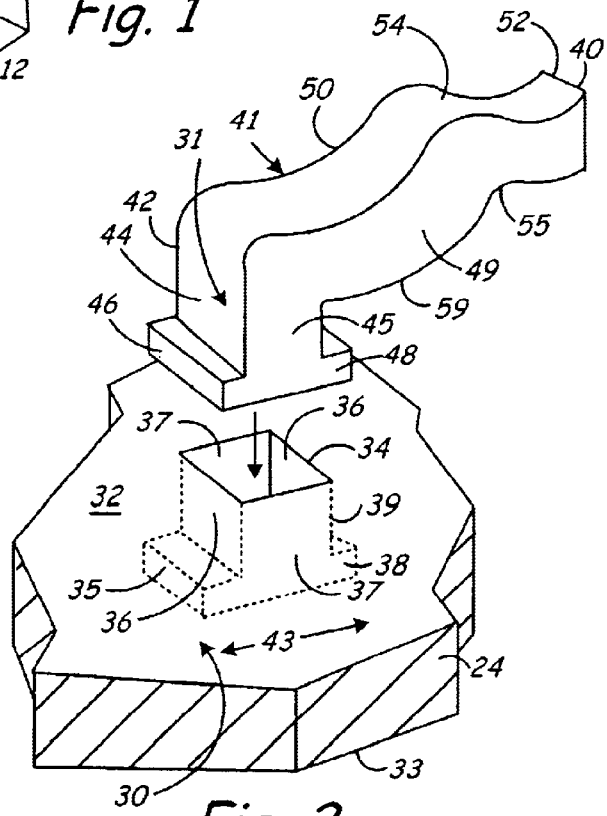
FIG. 2 is an isometric exploded view of one embodiment of an ejector in accordance with the present invention on an ejector mount.

In accordance with the present invention, a cutting die embodying a glueless mounting system is provided for mounting ejector elements to a die board. One embodiment of the mounting system is illustrated in FIG. 2. As shown generally in FIG. 2 and also in FIGS. 3, 4 and 5, the ejector mounting system includes an ejector recess 30 formed in the die board 24 together with a mounting end 31 of the ejector element 29 for connection therewith. More specifically, the die board 24 includes an outer surface 32 and an inner surface 33. The ejector retaining recess 30 includes an opening 34 formed in the outer surface 32 of the die board 24 and a pair of retaining shoulder portions 35 and 38. The recess 30 further includes a neck or neck recess portion 39 extending from the opening 35 through the die board 24 to the retaining shoulder portions 35 and 38. The neck recess portion includes opposite front and back walls 36 and opposite side walls 37.

In the preferred embodiment, the opening 34 and thus the cross-sectional configuration of the neck portion 39 is shown as being substantially square or rectangular. However, the configuration of the opening 34 and the cross-sectional configuration of the neck portion 39 can be any one of a variety of configurations such as circular, elliptical or polygonal in addition to being square or rectangular. The retaining shoulder portions 35 and 38 are also shown as being squared off or generally rectangular; however, the shoulder portions 35 and 38 could also be of a variety of configurations as well. The retaining recess 30 may be formed in the die board 24 by any means known in the art including use of lasers, saws, morticing drill bits, regular drill bits, routers, or the like. Preferably, the opening 34 and neck portion 39 are formed through the die board. A router is then preferably utilized to form the shoulder portions 35 and 38 on the inside surface 33 of the die board 24.

Figure 3:
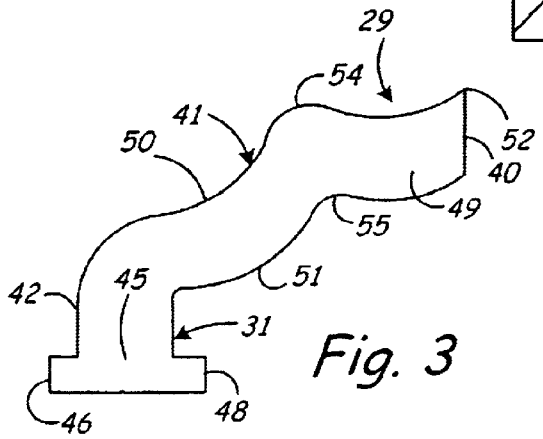
FIG. 3 is a side elevational view of the ejector shown in FIG. 2.
Figure 4:
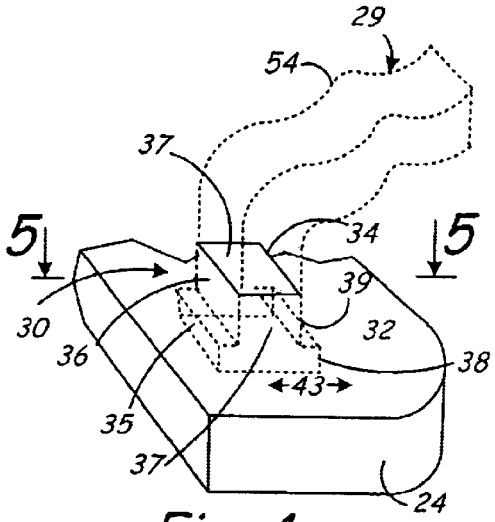
FIG. 4 is an isometric fragmentary view of a die board showing one embodiment of an ejector retaining recess with an inserted ejector shown in phantom.

Although the embodiment of the retaining recess shown in FIGS. 2 and 4 show only two shoulder portions 35 and 38 extending from the front and back neck walls 36, shoulder portions could also extend from the neck side walls 37, if desired. In the embodiment shown in FIGS. 2–5, the retaining recess 30 extends entirely through the die board 24. Thus, the inner portion of the recess 30 opens to the inner surface 33 of the die board 24.

The structure of the ejector element 29 intended for use with the retaining recess of FIGS. 2–5 is illustrated best in FIGS. 2 and 3. As shown, the ejector element 29 includes a base or mounting end 31, a free end 40 and an intermediate or ejecting portion 41.

Figure 5:
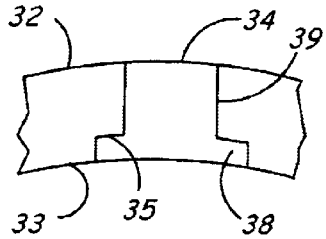
FIG. 5 is a view, partially in section, as viewed along the section line 5—5 of FIG. 4.

More specifically, the mounting end 31 includes a neck portion 42 having a size and cross-sectional configuration approximating that of the cross-sectional configuration of the neck portion 39 of the recess 30. The neck portion 42 includes front and back walls 44 and a pair of side walls 45. The bottom or inner end of the mounting end 31 includes a pair of protruding shoulder portions 46 and 48 which extend outwardly from the front and back walls 44 of the neck portion 42. The size and configuration of the protruding shoulder portions 46 and 48 approximate the size and configuration of the retaining shoulder portions 35 and 38 of the recess 30. Accordingly, when the ejector element 29 is mounted to the die board 24, the ejector neck 42 and in particular the front and back walls 44 and the side walls 45 conform to the neck recess 39, and in particular the front and back neck recess walls 36 and the neck side walls 37. Also when mounted as shown in FIG. 5, the protruding shoulder portions of 46 and 48 of the mounting end 31 engage and mate with the retaining shoulder portions 35 and 38 of the retaining recess 30. Preferably, the retaining shoulder portions 35 and 38 of the recess 30 extend from the neck in opposite directions along, or parallel to, the line of rotation 43.

The intermediate or ejecting portion 41 of the element 29 is integrally formed with the upper end of the mounting portion 31 and extends outwardly to the free end 40. The ejecting portion 41 includes a pair of sides 49 which are spaced from one another and are substantially coplanar with the side walls 45 of the neck portion 31. Preferably, the sides 49,49 are equally spaced and are thus parallel to one another. The ejector portion 41 also includes a top surface 50 and a bottom surface 51. The top surface 50 extends integrally from the back wall 44 of the neck 42 and terminates as an upper edge 52 at the free end 40. As shown best in FIGS. 2, 3, 4 and 6, the upper surface 50 is provided with a compression bump or hump 54 intermediate between the neck 42 and the edge 52. This compression bump 54 extends upwardly from the surface 50 as shown for the purpose of engaging the anvil cylinder 12 (FIG. 1). As will be described in greater detail below, during operation, engagement between the bump 54 and the cylinder 12 causes the free end 40, and in particular the edge 52, to move downwardly toward the die cylinder 11 to prevent the free end 40 or edge 52 from catching on the lead edge of a piece of sheet material. The size of the compression bump 54 should be sufficient to cause the edge 52 to move below the top edge of the cutting rule with which it is associated or below the anticipated level of the sheet material lead edge.

The bottom surface 51 of the element 29 extends from the front wall 44 of the neck 42 to the free end 40. As shown in FIGS. 2 and 3, an expansion recess 55 is formed in the surface 51 between the neck front wall 44 and the free end 40. Preferably, the expansion recess is in that area of the bottom surface 51 opposite the compression bump 54. The recess 55 functions to allow the portion 41 to lengthen and expand as the compression bump 54 engages the anvil cylinder 12. The recess 55, like the compression bump 54 can be positioned anywhere along the ejector portion 41, however, preferably, it is approximately mid-way between the neck 42 and the free end 40.

The specific material from which the ejector element 29 is constructed may vary depending upon its specific use and expected life span. For example, a more costly and durable elastomer may be used on high volume dies, while a lower cost and less durable rubber or elastomer may be used on low volume dies. The preferred material in accordance with the present invention is a closed cell highly durable synthetic polyurethane elastomer. Other rubber or rubber-like materials may also be used such as, but not limited, to those rubber or rubber-like materials currently used as scrap or other ejector elements in connection with cutting dies. In general, any natural or synthetic material which is compressible or resilient and compressible will function as the ejector material in accordance with the present invention. These will be referred to in the application as a "rubber" or a "rubber-like" material.

Preferably, the ejector element 29 of the present invention is constructed of a single rubber or rubber-like material; however, it is contemplated that in certain instances, a blend or combination of one or more rubber or rubber-like materials may be used without deviating from the spirit of the present invention. For example, in the embodiment shown in FIGS. 2 and 3, the top portion of the element 29 adjacent to the surface 50 could be a first rubber or rubber-like compressible material, while the lower portion adjacent to the surface 51 could be of a second rubber or rubber-like compressible material. Similarly, the portion of the element 29 near the mounting end 31 could be of a first rubber or rubber-like compressible material, while the portion near the free end 40 could be a second rubber or rubber-like compressible material.

Figure 10:
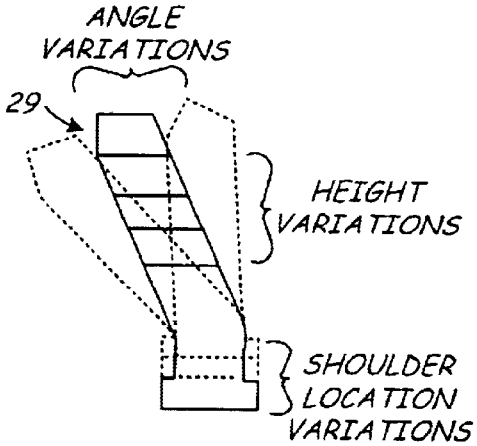
FIG. 10 is a side elevational view of one embodiment of the ejector element showing various structural modifications.
Figure 11:
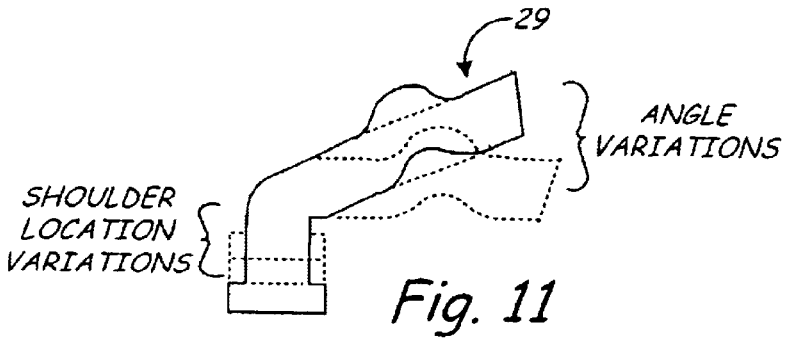
FIG. 11 is a side elevational view of a further embodiment of an ejector member showing various structural modifications.

FIGS. 10 and 11 show various structural modifications that may be made to the ejector elements 29. For example, FIG. 10 shows an alternate embodiment of a glueless ejector element which shows that the length of the neck portion 42 and thus the location of the shoulders 46 and 48 may vary, depending upon the particular type of mount. Further, as shown, the configuration of the intermediate or ejecting portion 41 may vary depending upon its specific use (either as a lead edge ejector or otherwise) as well as the height of the ejecting portion 41. FIG. 11 also shows that the length of the neck portion 42, and thus the position of the shoulders 46 and 48, may vary depending upon the particular mount with which the element 29 is used. Further, FIG. 11 shows that the specific angle at which the ejector portion 41 extends from the mounting end or neck 42 may vary, depending upon the particular application.

Figure 6:
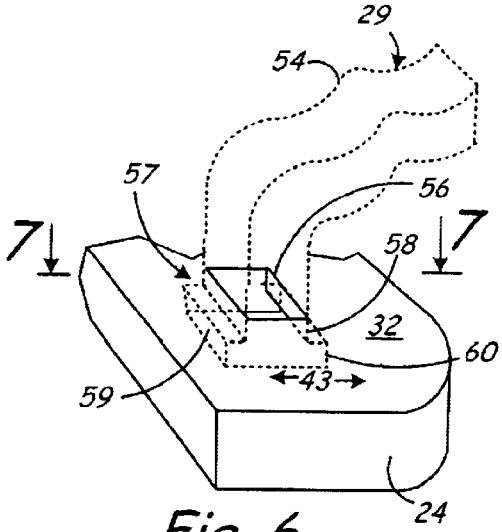
FIG. 6 is an isometric fragmentary view of a die board showing a further embodiment of an ejector retaining recess with an inserted ejector shown in phantom.
Figure 7:
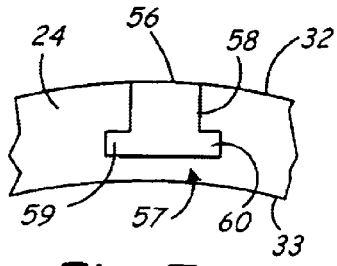
FIG. 7 is a view, partially in section, as viewed along the section line 7—7 of FIG. 6.

A further embodiment of an ejector retaining recess in accordance with the present invention is illustrated in FIGS. 6 and 7. This embodiment is similar to the embodiment illustrated in FIGS. 4 and 5, except that the recess does not extend all the way through the die board 24. Specifically, the embodiment of FIGS. 6 and 7 includes an opening 56 in the outer surface 32 of the die board, a pair of retaining shoulder portions 59 and 60, and a neck portion 58 extending from the opening 56 to the shoulder portions 59 and 60. Unlike the embodiment of FIGS. 4 and 5, the shoulder portions 59 and 60 of the embodiment of FIGS. 6 and 7 do not open to the inner surface 33, but are spaced outwardly from the inner surface 33. The ejectors to be received in this retaining recess are identical to those to be used with the retaining recess of FIGS. 4 and 5, except that the length of the neck portion 42 is shorter. When mounted into the recess 57, the protruding shoulder portions 46 and 48 of the element 29 engage and mate with the recessed shoulders 59 and 60 and the neck 42 extends through the opening 56 and engages the sides of the neck recess 58.

Figure 8:
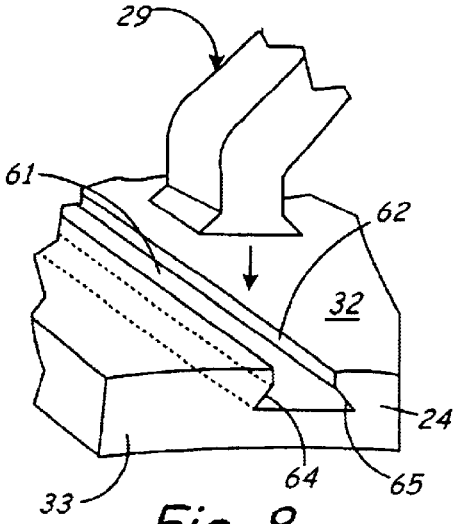
FIG. 8 is an isometric fragmentary view of a die board with a further embodiment of an ejector retaining recess.
Figure 9:
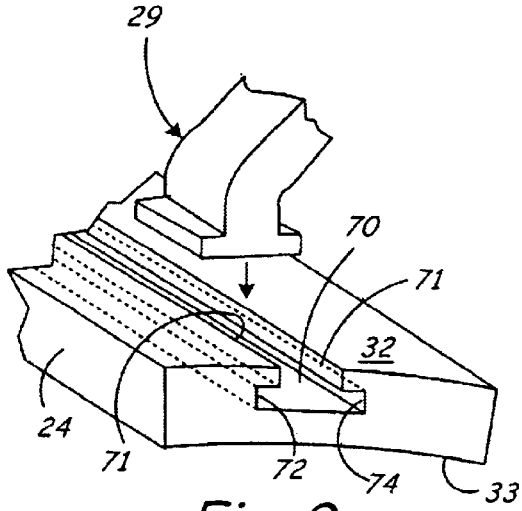
FIG. 9 is an isometric, fragmentary view of a die board with a further embodiment of an ejector retaining recess.

The embodiment of FIG. 9 is similar to that of FIG. 8 in that it comprises an elongated, axially extending slot opening to the outer edge of the die board 24 and having an opening 70 formed in the outer surface 32 of the die board 24, a neck 71 and a pair of retaining shoulders 72 and 74 extending outwardly from the neck 71. The cross-sectional configuration of the retaining recess of FIG. 9 is similar to that of FIGS. 6 and 7 and thus is designed to receive an ejector element with a mounting end 31 similar to the embodiment shown in FIGS. 2 and 3.

Although the embodiment of FIGS. 8 and 9 show the slots as being formed in an axial direction relative to the die cylinder 11, the slots can also be formed in a circumferential direction which is parallel to the rotational direction of the cylinder 11 or diagonal to the rotational direction. Further, the slot width can be varied depending upon the desired application and the slots can be cut using a dovetail router bit, a T-slot cutter bit or a keyhole router bit, among other means.

The ejector elements 29 can be inserted into the slots of FIGS. 8 and 9 in several ways. First, they can be inserted by inserting the shoulder portions of the ejector element directly into the shoulder recesses of the slots using a tool such as a bladed screwdriver or the like. Alternatively, the elements 29 can be inserted into the slot in a lengthwise direction of the channel or slot and by pushing the elements down into the slot until the bottom of the mounting end engages the bottom of the recess. The ejector element is then turned 90° so that the shoulders of the ejector element engage the shoulders in the slots. As a further alternative, the ejector element can be inserted into the slots from their open end and then slid into the required position in a lengthwise direction along the slot.

In all of the embodiments shown in FIGS. 4–9, the retaining recess is formed or cut directly in the die board. However, retaining recesses of these embodiments can also be provided by forming a hole into the die board and installing a molded insert that has the desired retaining recess. Such molded inserts can be installed into, or secured to, the die board in a variety of ways. These may vary from a press fit or threaded connection to a more permanent method such as gluing the insert into the die board.

Figure 12:
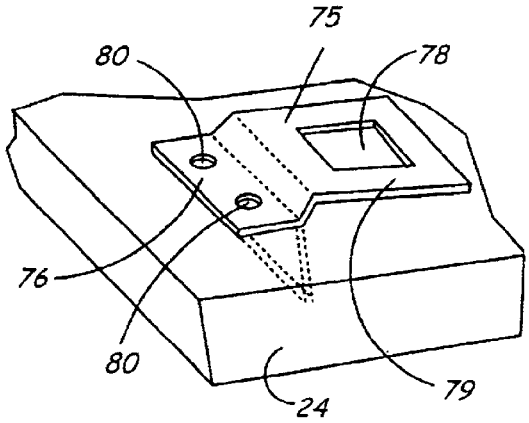
FIG. 12 is an isometric, fragmentary view of an alternate surface mounting arrangement for an ejector in accordance with the present invention.

A still further mounting embodiment is illustrated in FIG. 12. The embodiment of FIG. 12 utilizes a flanged retaining member to hold the ejector elements and to mount the same to the outer surface of the die board. Specifically, the flanged member 75 of FIG. 12 includes a flange 79 spread above the upper surface of the die board 24 and an ejector mounting opening 78. The flange 79 is connected to the board 24 via the connection flange 76. A pair of holes 80,80 are provided in the flange 76 for connection to the board 24.

Figure 13:
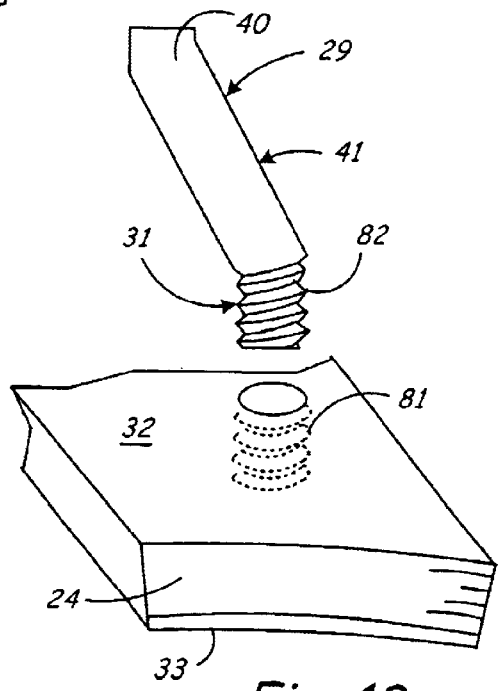
FIG. 13 is an isometric, fragmentary view of a die board with a still further embodiment for connecting an ejector to a die board without glue.

A further ejector and die board mounting option is illustrated in FIG. 13. In this embodiment, an internally threaded hole is formed in the die board 24 from the outer surface 32 toward the inner surface 33 to a desired depth, but preferably not completely through the die board. The ejector element 29 designed for mounting to this hole 81 includes a free end 40, an ejector portion 41 and a mounting end 31 comprised of a threaded base end with a plurality of external threads 82. The external threads 82 are designed to mate with the internal threads of the threaded opening 81. In this embodiment, the ejector element 29 is installed by turning the threaded end 82 into the threaded hole 81 in the die board from the outer surface to the desired depth and to the desired direction of position. It is also possible to eliminate the threads 82 on the mounting end 31. If this is done, the unthreaded ejector element 29 may be pressed or twisted into the threaded hole 81. After being pressed in, the unthreaded rubber material at the end 31 will tend to expand into the threads in the die board to retain the element 29. Removal of the ejector element 29 of FIG. 13 from the hole 81 requires turning the element 29 back out of the die or manually pulling the element loose. If the ejector breaks off, a pliers may be necessary.

Figure 14:
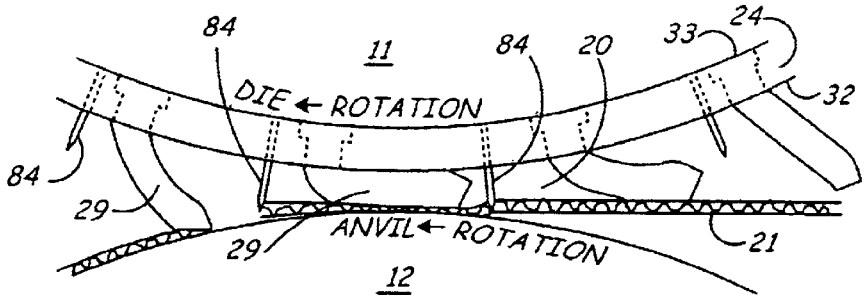
FIG. 14 is a view showing the nip area between the die and anvil cylinders and the operation of an ejector in accordance with the present invention.

FIG. 14 shows operation of an ejector element 29 which has been mounted to a die board 24. As shown, the die board 24 includes a plurality of cutting rules or knives 84. These are mounted to the die board 24 in a conventional manner so that their outer, cutting edge extends outwardly from the outer surface 32. Positioned between each of the cutting rules 84 is an ejector element 29 similar lo that illustrated in FIG. 10, although it could be similar to that illustrated in FIGS. 2 and 3 or any other configuration as well. As the die cylinder 11 and anvil cylinder 12 rotate in the direction indicated, a piece of sheet material 21 is fed into the nip 20 between the cylinders 11 and 12. As shown, as the ejector elements 29 engage the sheet material 21, they are bent over and compressed as the sheet material moves through the nip area 20. As the sheet material 21 moves through this area, the cutting rules 84 cut the sheet 21 as shown. As the cut piece of material leaves the nip area between the cylinders 11 and 12, the ejector element 29 expands and springs back to its original form, thereby forcing the cut piece of sheet material 21 away from the cutting rules 84 and away from the adjacent section of sheet material. Accordingly, the ejector 29 shown in FIG. 14 is bent over and compressed against the die board surface as a result of contact with the sheet material. This compressed element 29 provides the initial ejection of the material out of the die cavity and away from the die board. Since the ejector element 29 is mounted by a relatively narrower base than conventional rubber ejectors, there is no overlapping of materials to cause overcompression. Thus, the ejector element embodiments 29 of the present invention allow the material to freely stretch during the motion of flexing over and returning to the original location with minimal stress to either the mount or to the rubber material itself.

Figure 15:
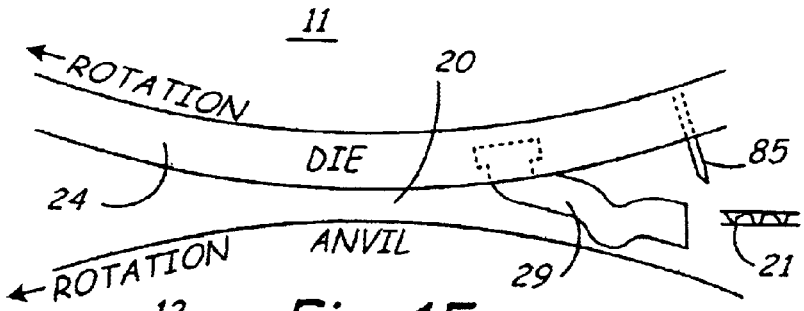
FIGS. 15, 16, 17 and 18 are views showing the nip area between the die and anvil cylinders and an ejector in accordance with the present invention used as a lead edge ejector.

FIGS. 15, 16, 17 and 18 show use of the ejector element of FIGS. 2, 3 and 11 as a lead edge ejector. FIG. 15 shows a die cylinder 11, an anvil cylinder 12 and a die board 24 mounted to the cylinder 11. The cylinder 11 is provided with a lead edge cutting rule 85, with the lead edge ejector element 25 positioned ahead of the rule 85 so that the ejector passes through the nip area 20 before the rule 85.

Figure 16:
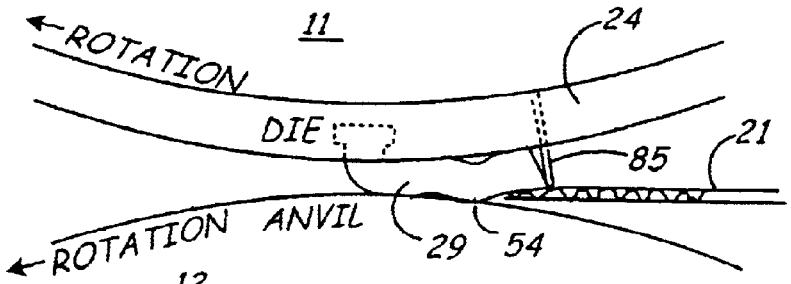

In FIG. 15, the ejector element 29 is shown in its relaxed, unstressed position prior to entering the press nip area 20. In this position, the corrugated or other sheet material 21 is being inserted. As the rotation of the cylinders II and 12 continues as shown in FIG. 16, the anvil cylinder 12 engages the compression bump 54. This causes the free end 40 of the ejector element 29 to move toward the die cylinder 11 as the sheet material 21 enters the nip area 20. Accordingly, the bump 54 and the relief area 55 compress and force the free end 40 Toward the rule 85 to eliminate any gaps for trim to lodge into. Thus, on each cutting rotation, the effective length of the element 29 effectively extends as it is compressed to eliminate any spacing between the element 29 and the rule 85.

Figure 17:
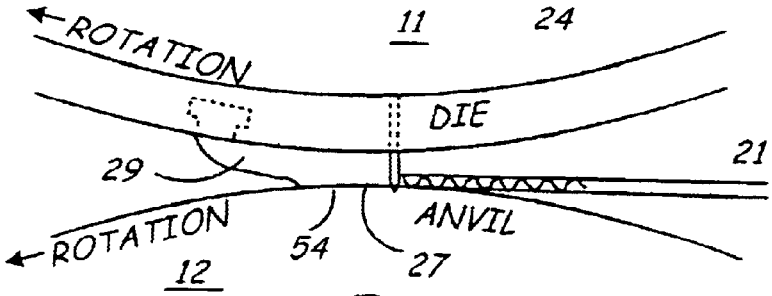
Figure 18:
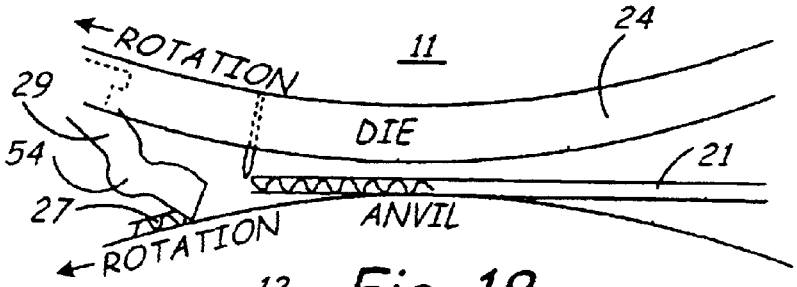

As the rotation continues as shown in FIG. 17, the element 29 is sufficiently compressed to provide the initial ejection force to move the material piece 27 away from the cutting die. Upon leaving the nip area 20 as shown in FIG. 18, the ejector element 29 returns to its relaxed, unstressed position carrying the piece 27 away from the remainder of the sheet material 21.

Figure 19:
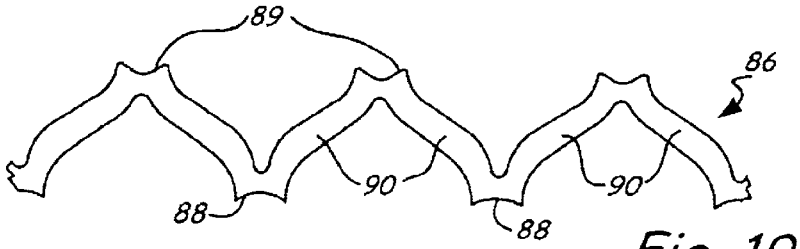
FIG. 19 is a side elevational view of a further embodiment of an ejector configuration.
Figure 20:
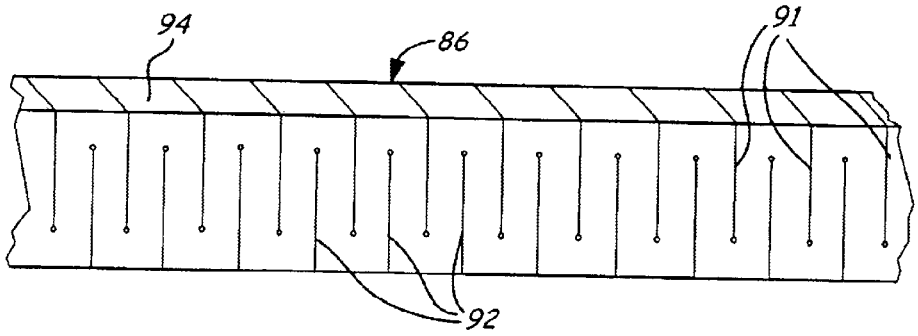
FIG. 20 is an isometric view of a section of strip material showing the manner of manufacturing the ejector member of FIG. 19.
Figure 21:
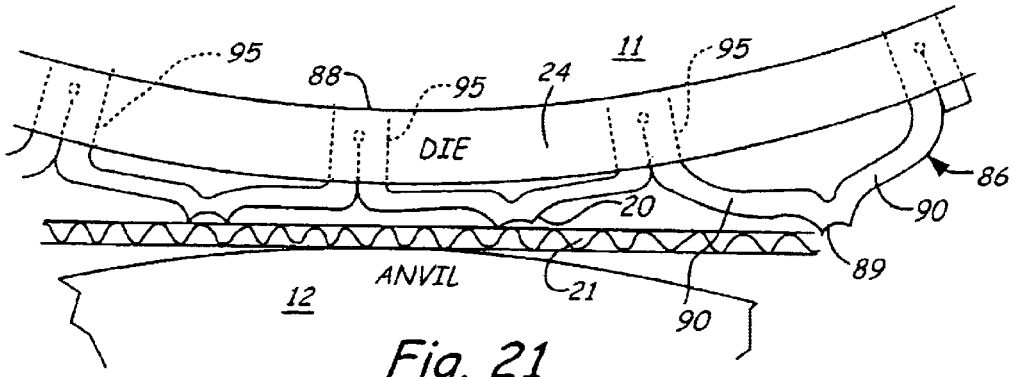
FIG. 21 is a view of the nip area between the die and anvil rollers showing the ejector members of FIG. 19 mounted in a die plate.

A still further embodiment of a glueless ejector mounting system in accordance with the present invention is shown in FIGS. 19, 20 and 21. The ejector element 86 shown in FIG. 19 is an accordian strip of rubber or rubber-like material that can be pressed into a series of square or rectangular mounting holes in a die board or the like. Specifically, the ejector 86 includes a plurality of laterally spaced mounting portions 88 and a plurality of oppositely positioned ejector portions 89. These mounting portions 88 and ejector portions 89 are connected by resilient bridging arms 90 as shown. As shown in FIG. 20, the element 86 of FIG. 19 can be constructed by cutting alternate slits 91 and 92 into a strip 94 of rubber or rubber-like material. By cutting the slits 91 and 92 as shown, the resulting embodiment can be opened up and stretched in accordian-like fashion to the structure illustrated in FIG. 19.

To mount the structure FIG. 19 to a die board, a series of square or rectangular mounting holes 95 is provided in a die board 24, with adjacent mounting portions 88 being pressed into adjacent mounting holes 95 as shown in FIG. 21. As the portion of the bridging arms 90 and ejection portions 89 enter the nip area 20, the ejection portion 89 will be compressed down toward the die board surface so as not to interfere with the sheet material 21 being cut. As the portions 89 and 90 leave the nip area 20, they return to their original shape, providing the ejection force to lift the material out of the die. This type of ejector 86 would most likely be used as sheet or product ejection in situations where there is a concern with the material being crushed, such as corrugated paper flutes. It can also be used when an enhanced lift is desired for an area that is difficult to eject the product from the die cavity. With the ejector embodiment 86 of FIGS. 19–21, the ejection force created on the sheet material can be varied by varying the height of the original strip 94 and thus the bridging arms 90, by varying the distance between the slits 91 and 92 and thus the thickness of the bridging arms 90 and by varying the spacing between the mounting holes 95.

Although the description of the preferred embodiment has been quite specific, it is contemplated that various modifications could be made without deviating from the spirit of the present invention. Accordingly, it is intended that the scope of the invention be dictated by the appended claims rather than by the description of the preferred embodiment.

What is claimed is:

1. A rotary cutting die comprising:

an anvil roller;

a die roller, said anvil roller and said die roller being spaced from one another to define a nip therebetween;

a die board mounted to said die roller and having an outer surface and an inner surface;

a cutting rule mounted to said die board;

an ejector mounted to said die board independently and separately from said cutting rule;

an ejector mounting means comprising a retaining recess in said die board, said retaining recess including an opening in said outer surface, an inner end and a recess shoulder portion positioned between said opening and said inner end;

said ejector being constructed solely of a resilient and compressible material and comprising a mounting end including a protruding shoulder portion positioned in said retaining recess for retaining engagement with said recess shoulder portion, a neck portion extending through said opening and an ejector portion including a free end extending outwardly from said outer surface.

2. The cutting die of claim 1 wherein said die roller rotates in a first direction.

3. The cutting die of claim 2 wherein said opening being spaced from said cutting rule.

4. The cutting die of claim 1 wherein said ejector extends from said opening in said outer surface and toward said cutting rule in a direction substantially parallel to said first direction so that said free end is positioned between said opening and said cutting rule.

5. The cutting die of claim 1 wherein said ejector is retained relative to said die board without glue.

6. The cutting die of claim 1 wherein said free end is opposite to said mounting end and said ejector includes an intermediate portion between said mounting end and said free end.

7. The new cutting die of claim 6 wherein said intermediate portion extends from said neck portion at an angle less than 180°.

8. The cutting die of claim 6 wherein said opening includes an opening dimension measured in a direction parallel to said first direction and wherein said intermediate portion has a dimension measured in a direction parallel to said first direction which is greater than said opening dimension.

9. The cutting die of claim 1 wherein said anvil roller and said die roller are substantially cylindrical.

10. The cutting die of claim 1 wherein said ejector is a single-piece structure.

11. The cutting die of claim 10 wherein said ejector is constructed of the same material throughout.

12. A method of mounting an ejector to a cutting die comprising:

providing a die board with a cutting rule mounted thereto and with an outer surface and a retaining recess, said retaining recess comprising an opening in said outer surface and a recess shoulder portion;

providing an ejector constructed solely of a resilient and compressible material and comprising a mounting end including a neck portion and a shoulder portion protruding from said neck portion and further including an ejector portion connected with said neck portion; and mounting said ejector to said die board independently and separately from said cutting rule by inserting said mounting end into said retaining recess so that said neck portion extends through said opening, said protruding shoulder portion engages said recess shoulder portion and said ejector portion extends outwardly from said outer surface.

13. The method of claim 12 wherein said mounting end is inserted into said retaining recess through said opening.

14. The method of claim 12 including mounting an ejector to a die board without glue.

15. The method of claim 12 including providing a cutting die comprised of an anvil roller and a die roller wherein said die board is mounted to said die roller.

16. The method of claim 12 including inserting said mounting end into said retaining recess by compressing said shoulder portion and inserting said shoulder portion through said opening.

17. A cutting die comprising:

a die board having an outer surface and an inner surface;

a cutting rule mounted to said die board;

an ejector mounted to said die board independently and separately from said cutting rule;

an ejector mounting means for mounting said ejector to said die board independently and separately from said cutting rule, said mounting means including a retaining recess in said die board, said recess including an opening in said outer surface and a recess shoulder portion positioned between said outer and inner surfaces; said ejector having a retaining base, said retaining base including a neck portion extending through said opening and a protruding shoulder portion connected with said neck portion for retaining engagement with said recess shoulder portion wherein said ejector includes a mounting end defined by said retaining base, a free end opposite to said mounting end and an intermediate portion between said mounting end and said free end, wherein said intermediate portion extends from said neck portion at an angle and wherein said intermediate portion includes a hump portion.

* * * * *